US011463815B2

(12) United States Patent
Ji et al.

(10) Patent No.: US 11,463,815 B2
(45) Date of Patent: Oct. 4, 2022

(54) YOKE ASSEMBLY FOR TWO-WAY RECEIVER AND TWO-WAY RECEIVER HAVING THE SAME

(71) Applicant: EM-TECH Co., Ltd., Gyeongsangnam-do (KR)

(72) Inventors: Yong Ju Ji, Gyeongsangnam-do (KR); Jun Hee Han, Gyeongsangnam-do (KR); Jung Ho Kang, Gyeongsangnam-do (KR)

(73) Assignee: EM-TECH CO., LTD., Gyeongsangnam-do (KR)

( * ) Notice: Subject to any disclaimer, the term of this patent is extended or adjusted under 35 U.S.C. 154(b) by 0 days.

(21) Appl. No.: 17/204,981

(22) Filed: Mar. 18, 2021

(65) Prior Publication Data

US 2021/0297786 A1 Sep. 23, 2021

(30) Foreign Application Priority Data

Mar. 18, 2020 (KR) ..... 10-2020-0033065

(51) Int. Cl.
*H04R 9/02* (2006.01)
*H04R 9/06* (2006.01)
*H04R 11/02* (2006.01)

(52) U.S. Cl.
CPC ..... *H04R 11/02* (2013.01); *H04R 9/025* (2013.01); *H04R 9/063* (2013.01)

(58) Field of Classification Search
CPC ..... H04R 2209/026
See application file for complete search history.

(56) References Cited

U.S. PATENT DOCUMENTS

2010/0128891 A1 5/2010 Kondo et al.
2013/0195293 A1* 8/2013 Ko ..... H04R 1/24 381/191

FOREIGN PATENT DOCUMENTS

KR 200359898 Y1 8/2004
KR 1020040057071 1/2006
KR 101177322 B1 8/2012
KR 101870261 B1 * 6/2018 ..... H04R 1/2826

* cited by examiner

*Primary Examiner* — Mark Fischer
(74) *Attorney, Agent, or Firm* — Murphy, Bilak & Homiller, PLLC

(57) ABSTRACT

Disclosed are a yoke assembly having a magnetic field aggregation structure and a two-way receiver having the same. The yoke assembly for a two-way receiver provided in a two-way receiver having two speaker units sharing a portion of a magnetic field, includes a yoke including a cylindrical portion having a circular bottom surface and a side wall and a flange portion extending externally from an upper end of the side wall of the cylindrical portion and a first magnetically permeable plate attached to an upper surface of the flange portion.

6 Claims, 9 Drawing Sheets

YOKE ASSEMBLY FOR TWO-WAY RECEIVER AND TWO-WAY RECEIVER HAVING THE SAME

TECHNICAL FIELD

The present disclosure relates to a yoke assembly having a magnetic field aggregation structure and a two-way receiver having the same.

BACKGROUND

FIG. 1 is a view showing a two-way speaker 1 according to the related art. In the related art two-way speaker 1, a cover 10 is coupled to an upper side of a frame 11 with an open upper portion and a yoke 12 is coupled to an upper portion of the frame 11 inside a cover 10 to form a space portion in which a large speaker portion 30 is formed between a yoke bottom plate 12-1 and a bottom surface of the frame 11.

In the yoke 12, a yoke cylinder 12-2 is integrally formed on an outer circumference of the yoke bottom plate 12-1 formed in a disk shape, a yoke flange 12-3 is integrally formed at the top of the yoke cylinder 12-2, and the yoke flange 12-3 slightly protrudes from an upper surface of the cover 10.

A sound emission hole 40 is formed on the yoke flange 12-3 and an upper surface of the cover 10 so that sound generated in the large speaker portion 30 (to be described in detail) may be emitted (output) to the outside of a small speaker portion 20 (to be described in detail) through the sound emission hole 40.

In the yoke 12, a first magnet 13 provided with a first magnetic plate 15 is installed (fixed) on an upper surface of the yoke bottom plate 12-1 to form a first air gap 26 between an outer circumference of the first magnet 13 and the yoke cylinder 12-2, and the small speaker portion 20 is installed at the yoke flange 12-3 above the first magnet 13.

In the related art, since the yoke 12 is generally machined through pressing, the yoke flange 12-3 is formed by bending an outer circumferential portion of the yoke cylinder 12-2. Accordingly, a bent portion between the yoke cylinder 12-2 and the yoke flange 12-3 inevitably includes a round-shaped section. FIG. 2 is a diagram illustrating a magnetic field flow around a round section of a yoke of a two-way speaker according to the related art. As may be seen in the figure, the round section due to bending formation is vulnerable to magnetic flux leakage.

In addition, an outer circumference of a small vibration plate 21 included in the small speaker portion 20 is fixed to an upper surface of the yoke flange 12-3 by a small vibration plate holder 22. Here, in order to match the concentricity of the small vibration plate 21 and a voice coil 25, a separate jig should be disadvantageously used.

SUMMARY

Therefore, an object of the present disclosure is to provide a yoke assembly for a two-way receiver capable of improving leakage of magnetic flux due to a round portion that occurs in a yoke shaping process, and a two-way receiver having the same.

Another object of the present disclosure is to provide a yoke assembly for a two-way receiver having improved diaphragm and circuit part assemblability, and a two-way receiver having the same.

According to an aspect of the present disclosure, there is provided a yoke assembly for a two-way receiver provided in a two-way receiver having two speaker units sharing a portion of a magnetic field, including: a yoke including a cylindrical portion having a circular bottom surface and a side wall and a flange portion extending externally from an upper end of the side wall of the cylindrical portion; and a first magnetically permeable plate attached to an upper surface of the flange portion.

In addition, as another example of the present disclosure, the first magnetically permeable plate may include a rib concentric with the cylindrical portion protruding upward.

In addition, as another example of the present disclosure, the first magnetically permeable plate may include an escape portion for a circuit formed by deleting a portion of a region from the rib to an outer circumference.

In addition, as another example of the present disclosure, the yoke assembly may further include: a second magnetically permeable plate attached to a lower portion of a bottom surface of the yoke.

According to an aspect of the present disclosure, there is provided a two-way receiver including: a cylindrical frame having a space for accommodating a component; a yoke partitioning the internal space of the frame vertically and including a cylindrical portion and a flange portion formed at an outer circumference of the cylindrical portion; a first speaker unit disposed above the yoke and including a permanent magnet, a top plate, a voice coil, and a diaphragm; a second speaker unit disposed below the yoke and including a permanent magnet, a top plate, a voice coil, and a diaphragm; a protector coupled to a lower portion of the frame and protecting the second speaker; and a first magnetically permeable plate attached to an upper surface of the flange portion of the yoke.

In addition, as another example of the present disclosure, a sound emission hole emitting sound may be formed by deleting a portion of the flange portion of the yoke.

In addition, as another example of the present disclosure, the sound emission hole is provided in at least two positions.

In addition, as another example of the present disclosure, the two-way receiver may further include: a guide ring attached along an outer circumference on a lower surface of the diaphragm of the first speaker unit, wherein the first magnetically permeable plate may have an upwardly protruding circular rib, and an inner circumference of the guide ring may be in contact with the circular rib.

In addition, as another example of the present disclosure, the frame may be in contact with an outer circumference of the guide ring.

In addition, as another example of the present disclosure, the frame may include: a body portion surrounding the permanent magnet of the second speaker unit and abutting on the flange portion of the yoke, an upper side wall protruding to an upper end of the body portion, and a lower side wall protruding to a lower portion of the body portion.

In addition, as another example of the present disclosure, a portion of the upper side wall of the frame may be deleted, and a circuit board may be installed on a partial upper surface of the body portion of the frame located at an angle corresponding to the deleted upper side wall and the flange portion of the yoke.

The yoke assembly for a two-way receiver and the two-way receiver having the same provided in the present disclosure have the advantage of improving a magnetic flux density by attaching a separate magnetically permeable plate to the upper end of the yoke and improving an output by reducing a distance of an air gap.

In addition, in the yoke assembly for a two-way receiver and the two-way receiver having the same provided in the present disclosure, the concentricity of the diaphragm and the magnetic circuit may be easily aligned by providing a rib or protrusion guiding installation of the diaphragm in the magnetically permeable plate.

In addition, in the yoke assembly for a two-way receiver and the two-way receiver having the same provided in the present disclosure, a compact structure may be realized by implementing a sound emission port of a large drive unit and a terminal unit connecting upper and lower sides by utilizing a small vibration meter outer area outside a relatively small speaker unit based on a difference in size of a dual magnetic field structure.

Those skilled in the art will recognize additional features and advantages upon reading the following detailed description, and upon viewing the accompanying drawings.

DETAILED DESCRIPTION

Hereinafter, the present disclosure will be described in more detail with reference to the accompanying drawings.

Figure 3:
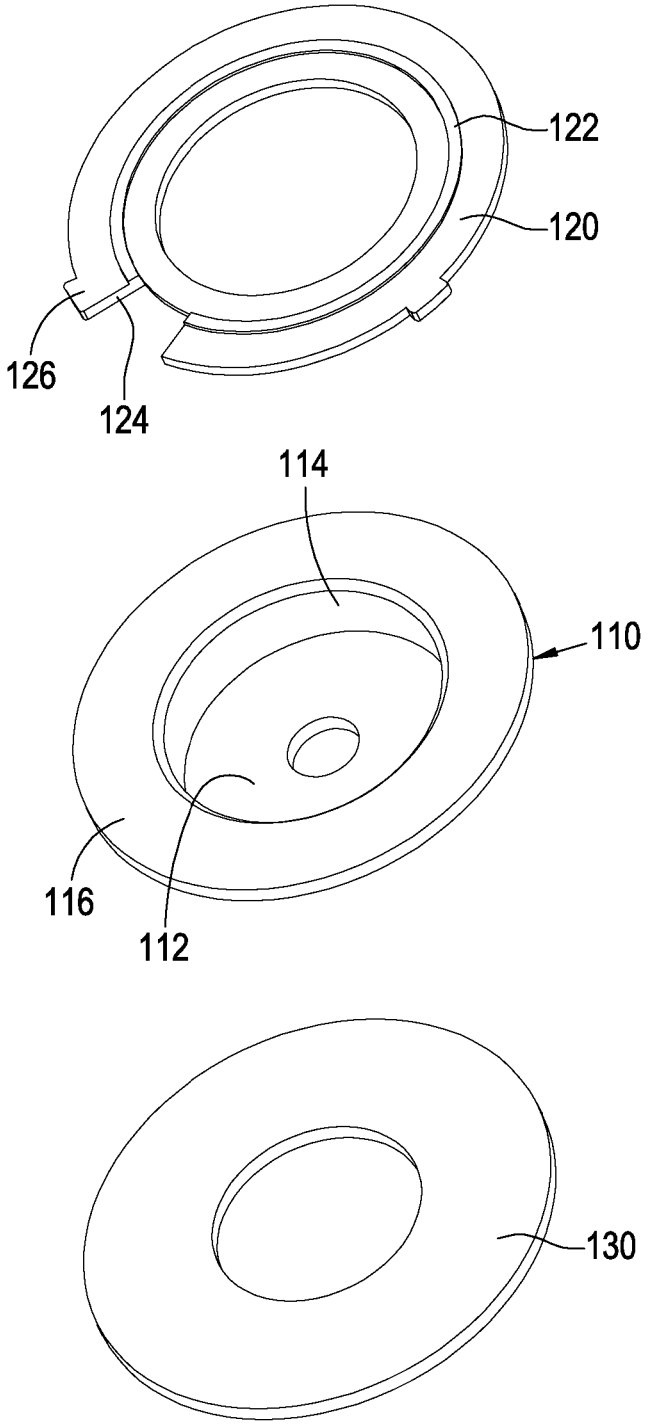
FIG. 3 is a view showing a yoke assembly according to a first embodiment of the present disclosure.

FIG. 3 is a view showing a yoke assembly according to a first embodiment of the present disclosure. The yoke assembly according to the first embodiment of the present disclosure includes a yoke 110, a first magnetically permeable plate 120 attached to an upper surface of the yoke 110, and a second magnetically permeable plate 130 attached to a lower surface of the yoke 100. Although the second magnetically permeable plate 130 is included in the first embodiment of the present disclosure, only the first magnetically permeable plate 120 may be included in the yoke assembly if necessary.

The yoke 110 includes a cylindrical portion having a circular bottom surface 112 and a side wall 114 bent upwardly outside the bottom surface 112 and a flange portion 116 extending outward from an upper end of the side wall 114 of the cylindrical portion.

The first magnetically permeable plate 120 includes a rib 122 protruding upward. Here, the rib 122 is preferably concentric with the cylindrical portion of the yoke 110. The rib 122 serves to guide an installation position of a diaphragm when the diaphragm of the receiver is seated, and thus has an advantage that the diaphragm and the yoke 110 may be concentrically aligned without a separate jig. When an outer portion of the diaphragm is seated in a normal position, a voice coil attached to the diaphragm may also be concentric with the yoke 110, but if the outer portion of the diaphragm is out of the original position, the voice coil and the yoke 110 may not be concentric, leading to a poor assembly and poor operation. Therefore, in order to match the concentricity of the diaphragm, in general, the diaphragm is attached on the yoke 110 in a state in which an assembly component (jig) is applied to the frame. However, in the present disclosure, since the rib 122 is formed on the upper surface of the first magnetically permeable plate 120, the rib 122 guides an attachment position of the diaphragm, and thus, the diaphragm, the voice coil, and a magnetic circuit may be easily concentrically aligned without a separate jig.

Meanwhile, the first magnetically permeable plate 120 may include an escape portion 124 for a circuit formed by deleting a portion of a region from the rib 122 on an inner side to an outer circumference on an outer side. The escape portion 124 is radially formed at a predetermined angle, and a lead wire of the voice coil may be drawn out through the escape portion 124 to be connected to a circuit part.

In addition, the first magnetically permeable plate 120 includes an installation protrusion 126 for fixing to the frame. The installation protrusion 126 further protrudes outward and abuts on a frame (to be described) to help locate the first magnetically permeable plate 120. The first magnetically permeable plate 120 may be installed so that the escape portion 124 for a circuit is brought to the correct position by the installation protrusion 126 and the frame.

Figure 1:
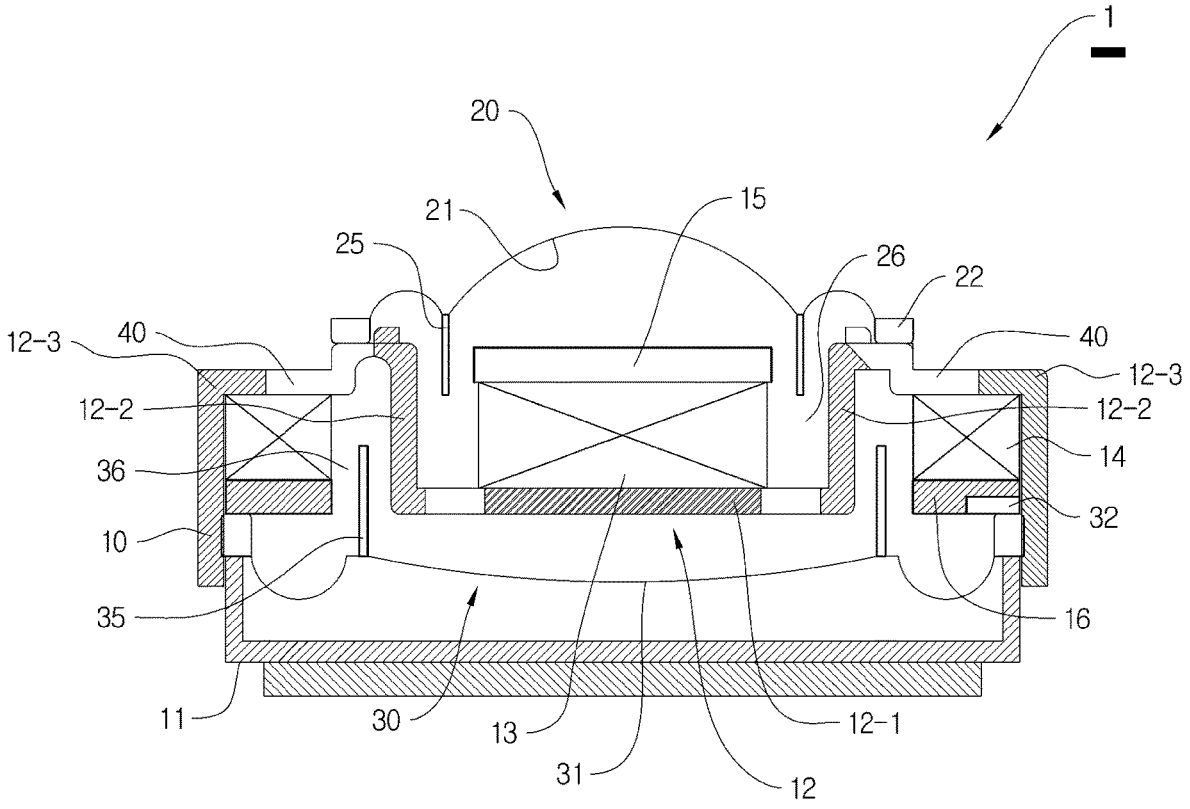
FIG. 1 is a view showing a two-way speaker according to the related art.
Figure 2:
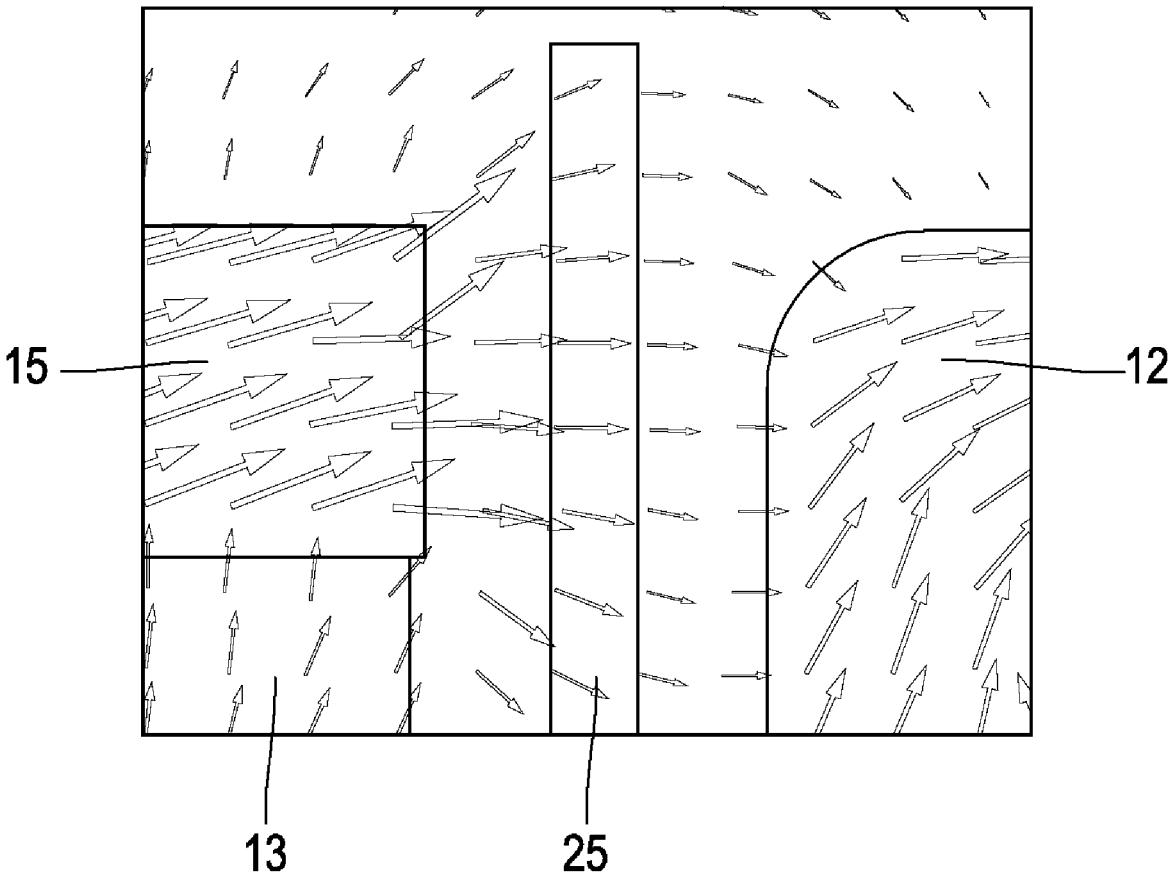
FIG. 2 is a diagram showing a magnetic field flow around a round section of a yoke of a two-way speaker according to the related art.
Figure 4:
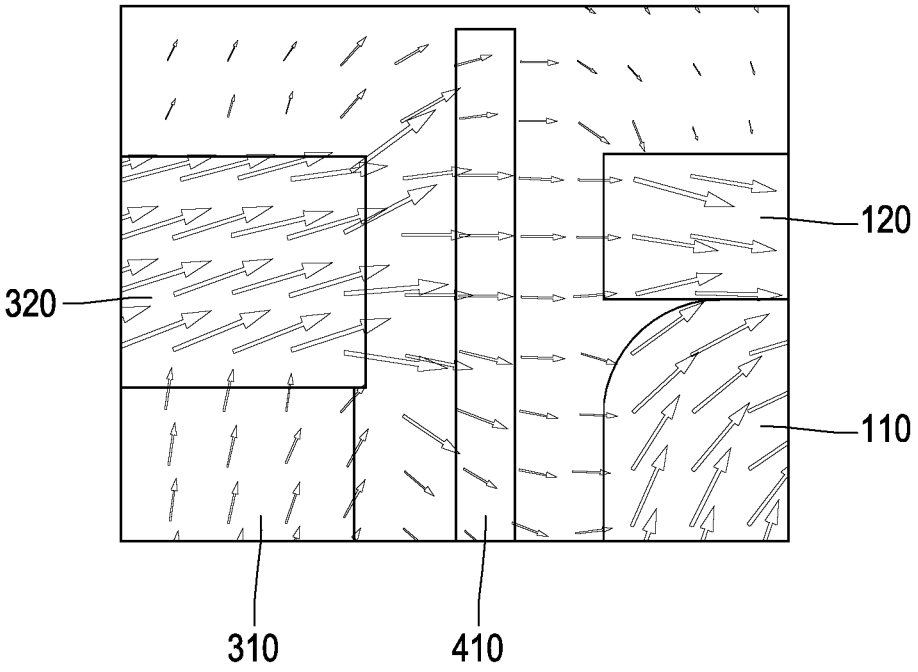
FIG. 4 is a view showing a magnetic field flow around a yoke and a first magnetically permeable plate of a two-way speaker according to the related art.

FIG. 4 is a view showing a magnetic field flow around a yoke and a first magnetically permeable plate of a two-way speaker according to the first embodiment of the present disclosure. Compared with the magnetic field flow in the two-way speaker according to the related art of FIG. 2, it can be seen that magnetic field aggregation is increased and magnetic flux leakage is reduced by applying the magnetically permeable plates 120 and 130 having high magnetic force on the upper and lower sides of the yoke 110. In the case of a structure with a large amount of magnetic flux leakage, the shape of the magnetically permeable plates 120 and 130 may be modified and applied to a section with a large amount of magnetic flux leakage.

Figure 5:
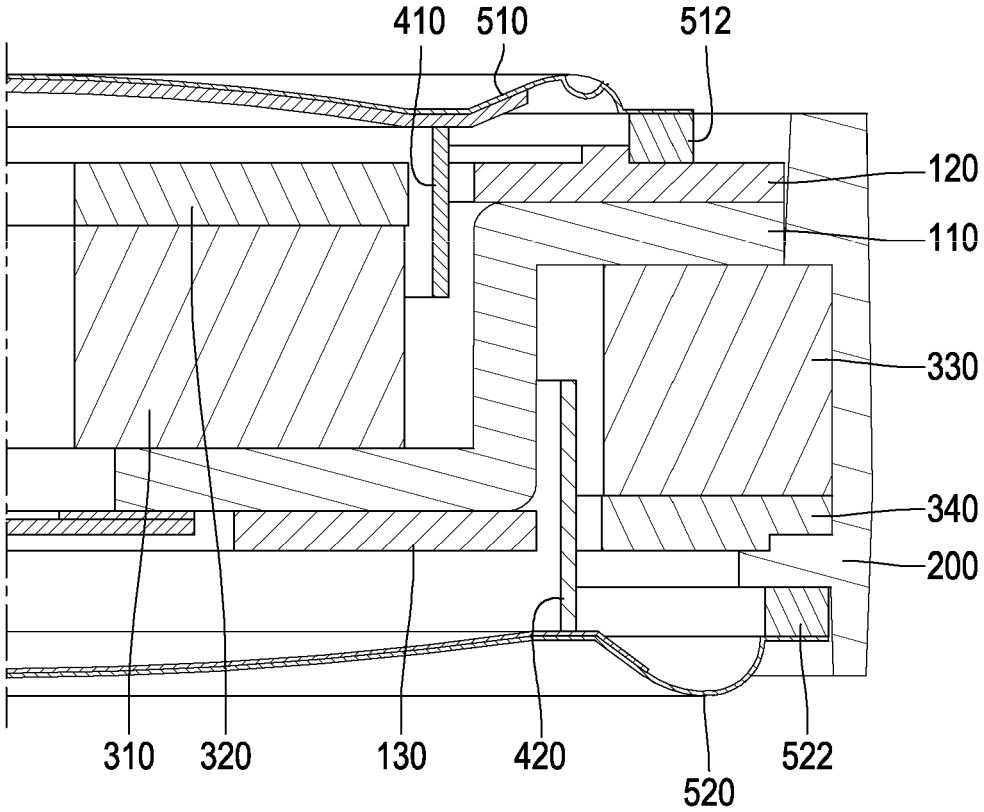
FIG. 5 is a cross-sectional view of a two-way speaker having a yoke assembly according to a first embodiment of the present disclosure.

FIG. 5 is a cross-sectional view of a two-way speaker having a yoke assembly according to a first embodiment of the present disclosure.

The two-way speaker according to the first embodiment of the present disclosure includes a yoke assembly including a yoke 110, a first magnetically permeable plate 120 attached to an upper surface of the yoke 110, and a second magnetically permeable plate 130 attached to a lower surface of the yoke 100.

A first speaker unit including a first permanent magnet 310, a first top plate 320, a first voice coil 410, and a first diaphragm 510 is installed above the yoke assembly. In addition, a second speaker unit including a second permanent magnet 330, a second top plate 340, a second voice coil 420, and a second diaphragm 520 is installed below the yoke assembly.

The first permanent magnet 310 concentric with the yoke 110 is attached in the cylindrical portion of the yoke 110, and the first top plate 320 is attached on the first permanent magnet 310. A diameter of the first permanent magnet 310 is smaller than that of the cylindrical portion of the yoke 110, and thus a first magnetic gap is formed between the cylindrical portion of the yoke 110 and the first permanent magnet 310. A lower end of the first voice coil 410 is positioned in the first magnetic gap, and an upper end of the first voice coil 410 is attached to the first diaphragm 510. A guide ring 512 having a predetermined thickness is attached to a lower surface of the first diaphragm 510 to facilitate installation of the first diaphragm 510. The guide ring 512, formed of a film material, is attached to improve gripping of the diaphragm or a difficulty of adjusting a position during assembly. The guide ring 512 is generally formed of an injection-molded product. As described above, the guide ring 512 is easily positioned by the rib 122 of the first magnetically permeable plate 120. The guide ring 512 has an inner diameter corresponding to an outer diameter of the rib 122 so that the first diaphragm 510 and the yoke 110 may be concentrically aligned without using a separate jig.

The second permanent magnet 330 is attached to a lower surface of the flange portion of the yoke 110 at a distance from the cylindrical portion of the yoke 110. In addition, the second top plate 340 is attached to a lower surface of the second permanent magnet 330. The second permanent magnet 330 and the second top plate 340 are generally insert-injected into the frame 200. At least a portion of the lower surface of the second top plate 340 is covered by the frame 200. An upper end of the second voice coil 420 is positioned in a second magnetic gap between the second permanent magnets 330 at a distance from the cylindrical portion of the yoke 110, and a lower end of the second voice coil 420 is attached to the second diaphragm 520. A second guide ring 522 is attached to an upper edge of the second diaphragm 520 to help install the second diaphragm 520. The second guide ring 522 is attached to the frame 200.

In addition, a portion of the side wall of the frame 200 covers a portion of the upper surface of the second permanent magnet 330. Here, an inner surface of the frame 200 may abut on an outer circumference of the flange portion of the yoke 110 and an outer circumference of the first magnetically permeable plate 120 to guide installation of the yoke 110 and the first magnetically permeable plate 120.

Meanwhile, in order to compensate for magnetic flux leakage in the bent portion between the bottom surface and the side wall of the yoke 110, the second magnetically permeable plate 130 may be attached to a lower surface of the bottom surface of the yoke 110 as described above.

Figure 6:
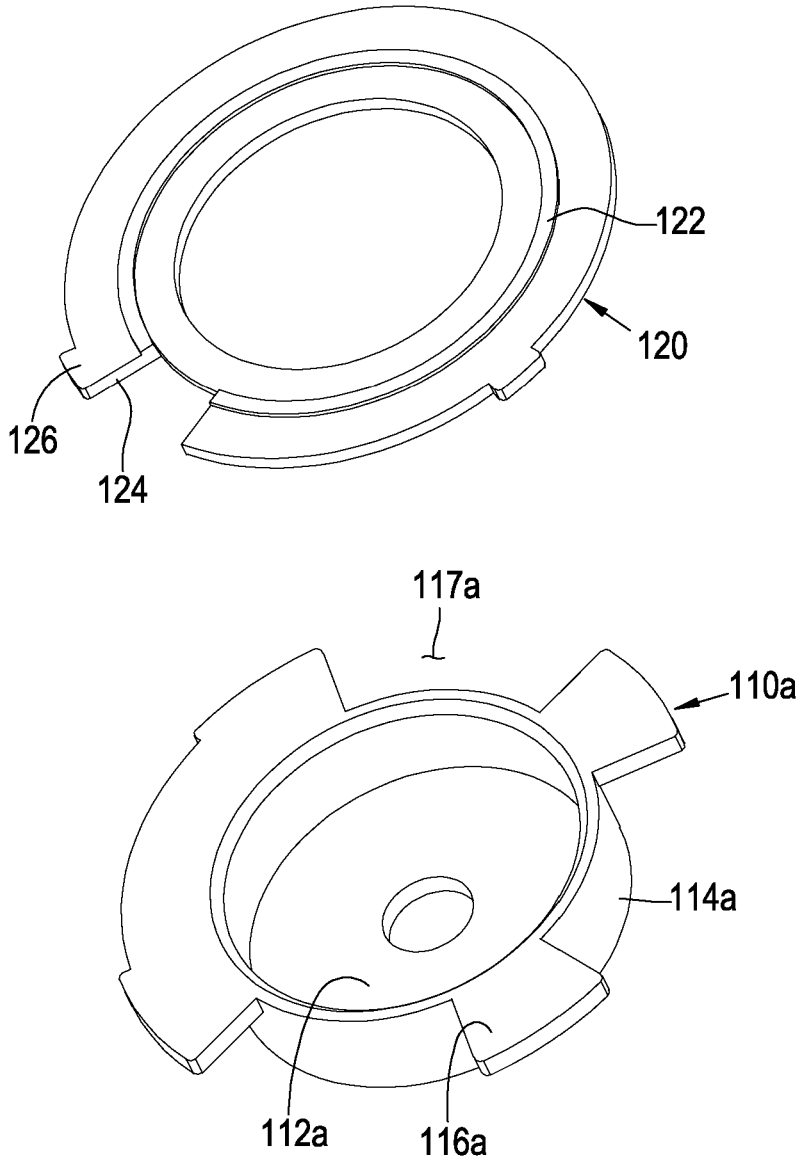
FIG. 6 is a view showing a yoke assembly of a two-way speaker according to a second embodiment of the present disclosure.

FIG. 6 is a view showing a yoke assembly of a two-way speaker according to a second embodiment of the present disclosure.

A yoke assembly of a two-way speaker according to the second embodiment of the present disclosure includes a yoke 110*a* and a first magnetically permeable plate 120*a*. A shape of the first magnetically permeable plate 120*a* is the same as that of the first embodiment, but the shape of the yoke 110*a* is different from that of the first embodiment.

The yoke assembly according to the second embodiment of the present disclosure, as in the first embodiment, the yoke 110*a* has a cylindrical portion having a circular bottom surface 112*a* and a side wall 114*a* bent upwardly outside the bottom surface 112*a* and a flange portion 116*a* extending outward from an upper end of the side wall 114*a* of the cylindrical portion. In this case, unlike the first embodiment, the flange portion 116*a* is not formed in the entire 360°, but a portion of the flange portion 116*a* is deleted and a portion of the frame is deleted to form a sound emission hole through which sound is emitted. One or more deleted sections 117*a* may be formed. A plurality of deleted sections 117*a* may be formed as necessary, and a length of the deleted section 117*a* may be easily adjusted as necessary.

It is possible to tune the characteristics of the second speaker unit installed below the yoke 110*a* according to the length and number of the deleted section 117*a*. Since a sound emission amount of the second speaker unit may be variously adjusted according to design of the deleted section 117*a*, balance of a low-frequency sound pressure may be adjusted.

Figure 7:
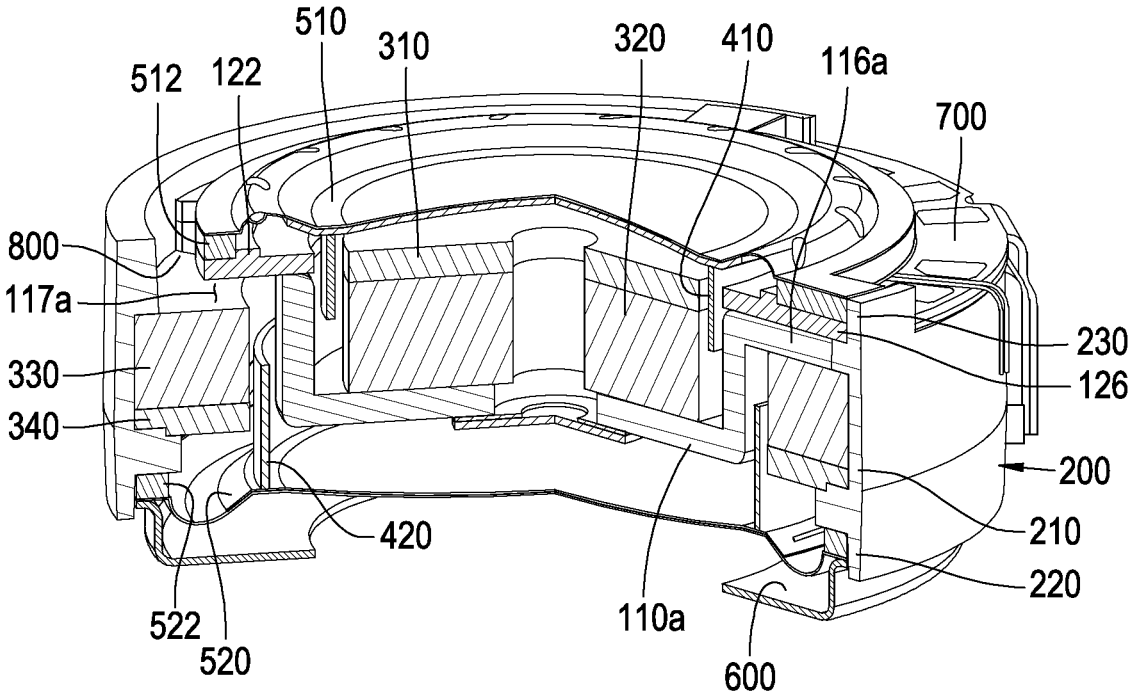
FIG. 7 is a partial cross-sectional view of a two-way speaker having a yoke assembly according to the second embodiment of the present disclosure.
Figure 8:
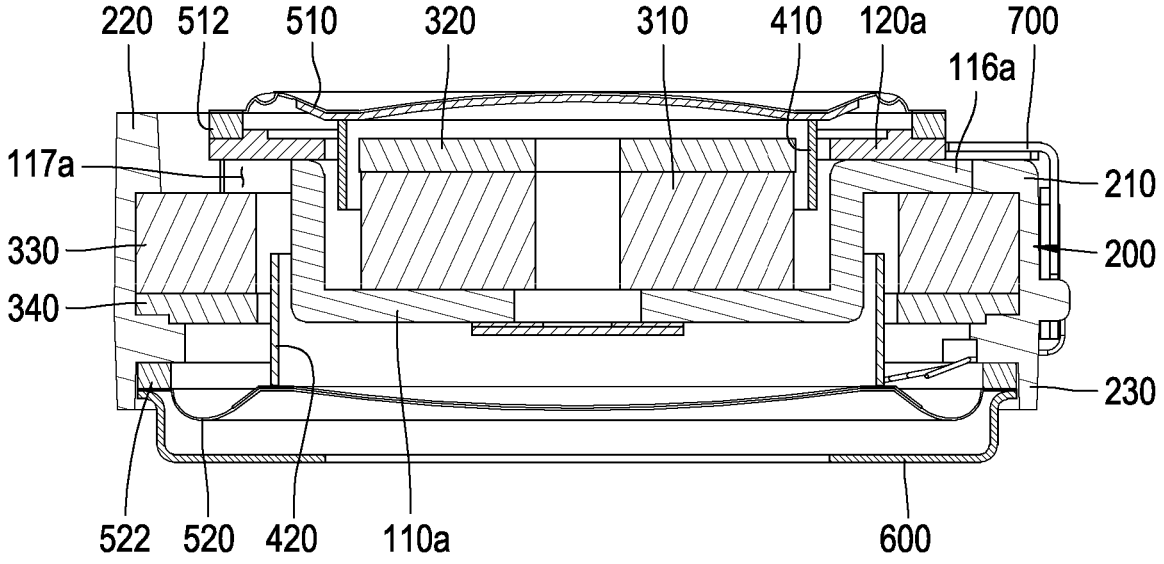
FIG. 8 is a front sectional view of a two-way speaker having a yoke assembly according to the second embodiment of the present disclosure.
Figure 9:
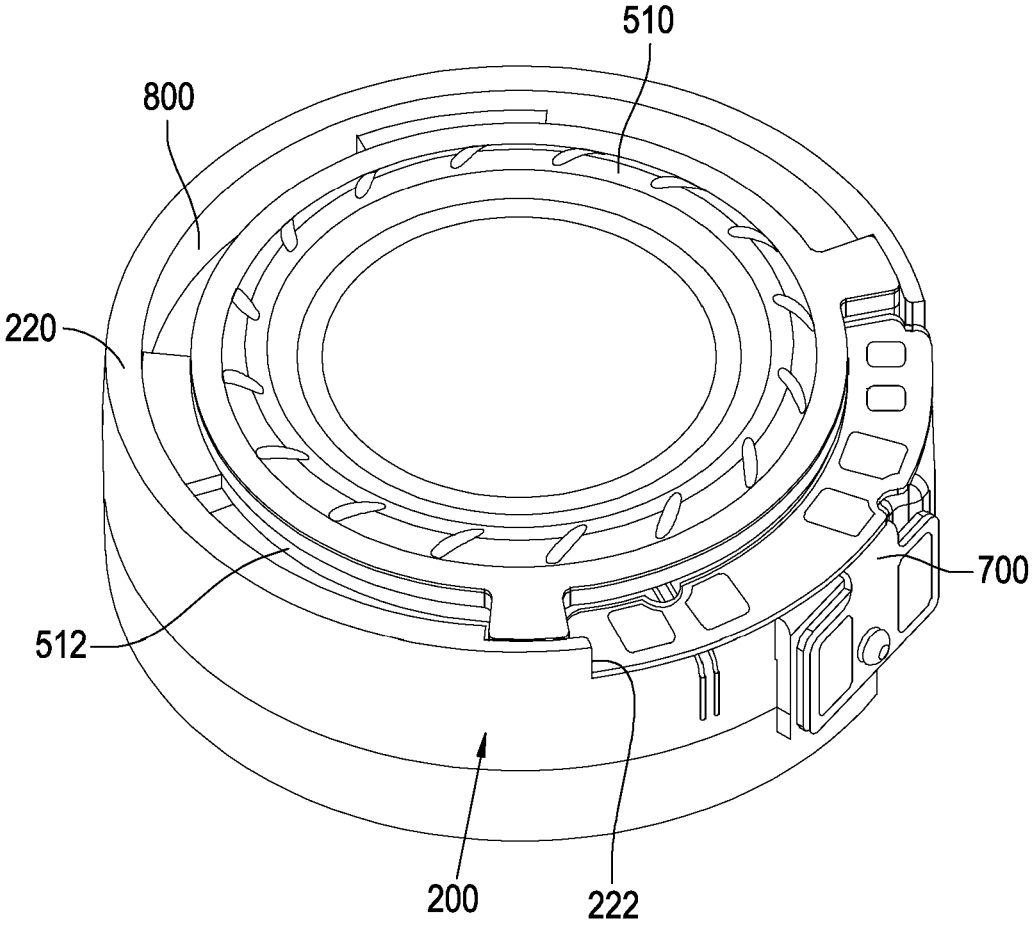
FIG. 9 is a perspective view of a two-way speaker having a yoke assembly according to the second embodiment of the present disclosure.

FIG. 7 is a partial cross-sectional view of a two-way speaker having a yoke assembly according to a second embodiment of the present disclosure, FIG. 8 is a front sectional view of a two-way speaker having a yoke assembly according to the second embodiment of the present disclosure, and FIG. 9 is a perspective view of a two-way speaker including a yoke assembly according to the second embodiment of the present disclosure.

A two-way speaker has a yoke assembly according to the second embodiment of the present disclosure. The two-way speaker according to the second embodiment of the present disclosure includes a yoke assembly including a yoke 110*a* and a first magnetically permeable plate 120*a* attached to an upper surface of the yoke 110*a*.

A first speaker unit including a first permanent magnet 310, a first top plate 320, a first voice coil 410, and a first diaphragm 510 is installed at an upper portion of the yoke assembly. In addition, a second speaker unit including a second permanent magnet 330, a second top plate 340, a second voice coil 420, and a second diaphragm 520 is installed at a lower portion of the yoke assembly.

The first permanent magnet 310 concentric with the yoke 110*a* is attached in the cylindrical portion of the yoke 110*a*, and the first top plate 320 is attached on the first permanent magnet 310. The first permanent magnet 310 has a diameter smaller than that of the cylindrical portion of the yoke 110*a*, and thus a first magnetic gap is formed between the side wall of the yoke 110*a* and the first permanent magnet 310. A lower end of the first voice coil 410 is positioned in the first magnetic gap, and an upper end of the first voice coil 410 is attached to the first diaphragm 510. A guide ring 512 having a predetermined thickness is attached to a lower surface of the first diaphragm 510 to facilitate installation of the first diaphragm 510. The guide ring 512, formed of a film material, is attached to improve gripping of the diaphragm or a difficulty of adjusting a position during assembly. The guide ring 512 is generally formed of an injection-molded product. As described above, the guide ring 512 is easily positioned by the rib 122 of the first magnetically permeable plate 120. The guide ring 512 has an inner diameter corresponding to an outer diameter of the rib 122 so that the first diaphragm 510 and the yoke 110 may be concentrically aligned without using a separate jig. In addition, the installation protrusion 126 provided in the first magnetically permeable plate 120 abuts on the upper side wall 210 of the frame 200. The installation protrusion 126 provided in the first magnetically permeable plate 120 guides a correct installation angle of the first magnetically permeable plate 120 to easily locate the escape portion 124 for a circuit (see FIG. 6) at a correct position.

The second permanent magnet 330 is attached to a lower surface of the flange portion of the yoke 110*a* at a distance from the side wall of the yoke 110*a*. In addition, the second top plate 340 is attached to a lower surface of the second permanent magnet 330. The second permanent magnet 330 and the second top plate 340 are generally insert-injected into the frame 200. At least a portion of the lower surface of the second top plate 340 is covered by the frame 200. An upper end of the second voice coil 420 is positioned in the second magnetic gap between the second permanent magnets 330 at a distance from the cylindrical portion of the yoke 110, and a lower end of the second voice coil 420 is attached to the second diaphragm 520. A second guide ring 522 is attached to an edge of an upper surface of the second diaphragm 520 to help install the second diaphragm 520. The second guide ring 522 is attached to the frame 200. The frame 200 may include a side wall 220 protruding downward to provide a position in which the second guide ring 522 is seated.

The frame 200 may include a body portion 210 surrounding the second permanent magnet 330, an upper side wall 220 protruding upward from the body portion 210 and guiding an installation position of the first magnetically permeable plate 120, and a lower side wall 230 protruding downward from the body portion 210 and helping install the second guide ring 522. Here, the body portion of the frame 200 may abut on an outer circumference of the flange portion 116*a* of the yoke 110*a* to guide an installation position of the yoke 110*a*. In addition, it is preferable that the upper side wall 220 of the frame 200 has a structure engaged with the installation protrusion 126 of the first magnetically permeable plate 120 to guide the installation angle of the first magnetically permeable plate 120.

Meanwhile, as described above, the flange portion 116*a* of the yoke 110*a* has a deleted section 117*a* formed by deleting a partial section, and a space between the deleted section 117*a* and the upper side wall 210 of the frame 200 forms a sound emission hole 800. The sound emission hole 800 may tune sound emission characteristics of the second speaker unit according to how many deleted sections 117*a* are formed in the flange portion 116*a* and how long the deleted section 117*a* is formed. A length of the sound emission hole 800 is determined according to an angle formed by both ends of the deleted section 117*a* as the flange portion 116 has a ring shape. One to several deleted sections 117*a* may be formed, and the angle of each deleted section 117*a* may be adjusted as desired, so there is an advantage that acoustic characteristics of the second speaker unit in charge of low sound may be widely adjusted.

Meanwhile, in the frame 200, a partial section of the upper side wall 220 may be deleted and a circuit board 700 may be installed in a portion of the body portion 210 of the frame 200 and the flange portion 116*a* of the yoke 110*a*. Here, a position where the circuit board 700 is installed is at an angle corresponding to the upper side wall 220 deleted on the body portion of the frame and the flange portion of the yoke.

In consideration of a difference in diameter and sectional area between the first speaker unit and the second speaker unit, an extra space formed at the outer circumference of the first speaker unit having a relatively small diameter is utilized as an installation space of the circuit board 700, thereby reducing an overall size of the receiver.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A two-way receiver, comprising:

a cylindrical frame having an internal space for accommodating a component;

a yoke vertically partitioning the internal space of the cylindrical frame and including a cylindrical portion having a circular bottom surface and a side wall, and a flange portion extending externally from an upper end of the side wall of the cylindrical portion;

a first speaker unit disposed above the yoke and including a permanent magnet, a top plate, a voice coil, and a diaphragm;

a second speaker unit disposed below the yoke and including a permanent magnet, a top plate, a voice coil, and a diaphragm;

a protector coupled to a lower portion of the frame and configured to protect the second speaker unit; and a first magnetically permeable plate attached to an upper surface of the flange portion of the yoke; and a guide ring attached along an outer circumference on a lower surface of the diaphragm of the first speaker unit, wherein the first magnetically permeable plate has an upwardly protruding circular rib, wherein an inner circumference of the guide ring is in contact with the circular rib.

2. The two-way receiver of claim 1, wherein a sound emission hole for emitting sound is formed by a deleted portion of the flange portion of the yoke.

3. The two-way receiver of claim 2, wherein the sound emission hole is provided in at least two positions.

4. The two-way receiver of claim 1, wherein the frame is in contact with an outer circumference of the guide ring.

5. The two-way receiver of claim 1, wherein the cylindrical frame includes a body portion surrounding the permanent magnet of the second speaker unit and abutting on the flange portion of the yoke, an upper side wall protruding to an upper end of the body portion, and a lower side wall protruding to a lower portion of the body portion.

6. The two-way receiver of claim 5, wherein a portion of the upper side wall of the cylindrical frame is deleted, and wherein a circuit board is installed on a partial upper surface of the body portion of the frame located at an angle corresponding to the deleted upper side wall and the flange portion of the yoke.

* * * * *